US006067426A

United States Patent [19]

Kawakami

[11] Patent Number: 6,067,426

[45] Date of Patent: May 23, 2000

[54] BRUSH TYPE CHARGER

[75] Inventor: Tomoyuki Kawakami, Niigata, Japan

[73] Assignee: NEC Corporation, Japan

[21] Appl. No.: 09/290,841

[22] Filed: Apr. 13, 1999

[30] Foreign Application Priority Data

Apr. 14, 1998 [JP] Japan ..... 10-102975

[51] Int. Cl.[7] ..... G03G 15/02

[52] U.S. Cl. ..... 399/50; 399/175

[58] Field of Search ..... 399/50, 168, 174, 399/175, 176

[56] References Cited

U.S. PATENT DOCUMENTS

| | | | |
|---|---|---|---|
| 5,508,879 | 4/1996 | Kitamura et al. | 399/175 X |
| 5,568,231 | 10/1996 | Asano et al. | 399/175 |
| 5,576,807 | 11/1996 | Osawa et al. | 399/175 |
| 5,587,775 | 12/1996 | Taniguchi et al. . | |
| 5,606,401 | 2/1997 | Yano . | |
| 5,689,777 | 11/1997 | Yamamoto et al. | 399/174 |
| 5,751,405 | 5/1998 | Aita et al. . | |
| 5,754,926 | 5/1998 | Sakuraba et al. | 399/175 |

FOREIGN PATENT DOCUMENTS

| | | |
|---|---|---|
| 60-220587 | 11/1985 | Japan . |
| 4301861 | 10/1992 | Japan . |
| 5127492 | 5/1993 | Japan . |
| 6250495 | 9/1994 | Japan . |
| 7-98534 | 4/1995 | Japan . |
| 8-137187 | 5/1996 | Japan . |

*Primary Examiner*—Sandra Brase
*Attorney, Agent, or Firm*—Ostrolenk, Faber, Gerb & Soffen, LLP

[57] ABSTRACT

A brush type charger capable of reducing noise which occurs on superposing AC voltage on DC voltage and of restraining image defects such as moire images and density unevenness from occurring will be supplied.

In a brush type charger, having a shaft 1A for brush made of a conductive member, and a brush-shaped charging member 1B which is radially provided toward the outside around the shaft 1A for brush, and which is made of a conductive member entirely formed into a roller shape, configured such that the outer circumference of the brush-shaped charging member 1B is brought into contact with a photoreceptor 3 and predetermined DC voltage having AC voltage superimposed thereon is applied to the brush-shaped charging member 1B to thereby charge the photoreceptor 3, the brush-shaped charging member 1B is provided in a helical fashion around the shaft 1A for brush.

10 Claims, 7 Drawing Sheets

*FIG.5*

Moire-shaped image Density unevenness pitch: Pm [mm]

| Offset voltage: Vdc [V] | Frequency: f [Hz] | Peak-to-peak value: Vpp [V] | | | | |
|---|---|---|---|---|---|---|
| | | 600 | 700 | 800 | 900 | 1000 |
| -700 | 0 | — | — | — | — | — |
| | 50 | 0.90 | 0.90 | 0.45 | 0.45 | 0.45 |
| | 100 | 0.45 | 0.45 | 0.35 | 0.25 | 0.00 |
| | 150 | 0.30 | 0.20 | 0.20 | 0.20 | 0.00 |
| | 200 | 0.00 | 0.00 | 0.00 | 0.00 | 0.00 |
| | 300 | 0.00 | 0.00 | 0.00 | 0.00 | 0.00 |
| | 400 | 0.00 | 0.00 | 0.00 | 0.00 | 0.00 |
| -800 | 0 | — | — | — | — | — |
| | 50 | 0.90 | 0.90 | 0.45 | 0.45 | 0.45 |
| | 100 | 0.45 | 0.45 | 0.40 | 0.30 | 0.00 |
| | 150 | 0.30 | 0.35 | 0.30 | 0.20 | 0.00 |
| | 200 | 0.00 | 0.00 | 0.00 | 0.00 | 0.00 |
| | 300 | 0.00 | 0.00 | 0.00 | 0.00 | 0.00 |
| | 400 | 0.00 | 0.00 | 0.00 | 0.00 | 0.00 |
| -900 | 0 | — | — | — | — | — |
| | 50 | 0.90 | 0.90 | 0.45 | 0.45 | 0.45 |
| | 100 | 0.45 | 0.45 | 0.45 | 0.30 | 0.15 |
| | 150 | 0.35 | 0.35 | 0.35 | 0.20 | 0.00 |
| | 200 | 0.00 | 0.00 | 0.00 | 0.00 | 0.00 |
| | 300 | 0.00 | 0.00 | 0.00 | 0.00 | 0.00 |
| | 400 | 0.00 | 0.00 | 0.00 | 0.00 | 0.00 |

*FIG. 6*

Occurrence of noise by AC voltage superimposed

| Offset voltage: Vdc [V] | Frequency: f [Hz] | Peak-to-peak value: Vpp [V] | | | | |
|---|---|---|---|---|---|---|
| | | 600 | 700 | 800 | 900 | 1000 |
| -700<br>-800<br>-900 | 0 | ◎ | ◎ | ◎ | ◎ | ◎ |
| | 50 | ◎ | ◎ | ◎ | ◎ | ◎ |
| | 100 | ◎ | ◎ | ◎ | ◎ | ◎ |
| | 150 | ◎ | ◎ | ○ | ○ | ○ |
| | 200 | △ | △ | △ | △ | △ |
| | 300 | △ | △ | △ | △ | × |
| | 400 | × | × | × | × | × |

◎ : cannot be confirmed.
○ : to such a degree that it can be slightly confirmed.
△ : no problems in actual use although it occurs.
× : unfit

BRUSH TYPE CHARGER

BACKGROUND OF THE INVENTION

1. Field of the Invention

The present invention relates to a brush type charger, and more particularly to a brush type charger installed, for use, in an image forming apparatus such as a printer, a facsimile or a copying apparatus using an electrophotographic process.

2. Description of the Prior Art

Conventionally, in a process cartridge for use with this sort of electrophotographic process, there has been utilized a non-contact type corona charger using corona discharge as a charger for charging a charging object prior to formation of an electrostatic latent image.

The corona charger is effective as means for uniformly charging a charging object, but simultaneously has a problem that it causes ozone to occur with corona discharge.

Since it is capable of restraining occurrence of ozone in contrast to the non-contact type corona charger, a contact type charger has been put to practical use in many apparatuses in recent years.

Of the contact type chargers, when DC voltage is applied to a brush type charger, brush marks-shaped density unevenness caused by a brush occurs on an image. This brush marks-shaped density unevenness can be avoided by superposing AC component on DC voltage as applied voltage, and at the same time such a stable charging that is not affected by any environmental fluctuation, becomes possible.

According to the content of technical contents disclosed in, for example, Japanese Patent Application Laid-Open Nos. 60-220587 and 7-98534, it is disclosed that uniform charging is performed by applying voltage having AC voltage of high frequency wave superimposed on DC voltage to a brush charging device to provide an excellent image.

In the technique disclosed in the Japanese Patent Application Laid-Open No. 60-220587, however, noise occurs because an AC component of high frequency wave exceeding 500 Hz is superimposed.

Also, the technique disclosed in the Japanese Patent Application Laid-Open No. 7-98534 is an example applicable to a non-rotary type brush charging device, and therefore, it is difficult to maintain an excellent image over a long term, and the problem of noise also remains unsolved.

Further, as another known example, there is Japanese Patent Application Laid-Open No. 8-137187. In the technique disclosed in the Japanese Patent Laid-Open Application No. 8-137187, the frequency of AC voltage to be applied to a rotary type brush charging device is represented in terms of relation between process speed and brush pile pitch. The rotary type brush charging device has an advantage of being able to maintain an excellent image over a long term.

BRIEF SUMMARY OF THE INVENTION

Object of the Invention

On the other hand, in the above-described conventional contact type brush type charger, it was necessary to superimpose the AC component of very high frequency wave in order to prevent any moire-shaped image from being produced. For this reason, the inconvenience arose that noise is caused to occur by vibration which is generated between the brush portion of the brush type charger and the photoreceptor when the AC component of high frequency wave is superimposed.

Therefore, in order to prevent such noise from spreading to the outside, there was such cumbersomeness that any sound-absorbent material had to be placed inside a photoreceptor, within the apparatus, or inside the process cartridge.

As regards the occurrence of the moire-shaped image, nothing concerning the relation between the frequency f of superimposed voltage and the peak-to-peak value has been disclosed in any of the above described known examples.

It is an object of the present invention to provide a brush type charger capable of maintaining an excellent image over a long term by reducing the occurrence of noise when AC voltage is superimposed on DC voltage, and by restraining the occurrence of image defects such as moire images and brush marks-shaped density unevenness.

Summary of the Invention

In order to attain the above-described object, in a brush type charger, according to the present invention, having a shaft for brush made of a conductive member, and a brush-shaped charging member which is radially provided toward the outside around the shaft for brush, and which is made of a conductive member entirely formed into a roller shape, structured such that the outer circumference of the brush-shaped charging member is brought into contact with a photoreceptor and predetermined DC voltage having AC voltage superimposed thereon is applied to the brush-shaped charging member to thereby charge the photoreceptor, the structure that the above-described brush-shaped charging member is provided in a helical fashion around the shaft for brush is adopted as the basic structure.

For this reason, according to the present invention, predetermined DC voltage having AC voltage superimposed thereon is applied, and yet the tip end portion of the brush-shaped charging member can abut upon the entire surface of the photoreceptor substantially uniformly by the action of the brush-shaped charging member helically wound. Therefore, it is possible to effectively restrain image defects such as moire images and density unevenness, and to effectively reduce the occurrence of noise at the same time.

In this case, the frequency f of AC component of the voltage applied to the above-described brush-shaped charging member can be set so as to satisfy the relation of $100\ \text{Hz} \leqq f < 300\ \text{Hz}$.

Then, image defects such as the moire images and density unevenness can be restrained with reliability, and the occurrence of noise can be also reduced certainly and heavily.

Further, if the relation between the above described peak-to-peak value Vpp of AC component and the frequency f of AC component of the voltage applied to the brush-shaped charging member is set so as to satisfy the relation of "$Vpp \geqq 1200-2f$," image defects such as the moire images and density unevenness can be restrained with substantially 100% reliability, the occurrence of noise also can be reduced certainly and heavily to such a degree that no problem is presented in practical use without necessitating any sound-absorbent material, and this state can be maintained for many hours, thus making it possible to increase the reliability on the entire apparatus greatly.

Furthermore, the frequency f of AC component of the superimposed voltage may be made variable. As regards the above described brush-shaped charging member, it may be formed with conductive rayon yarn having fiber size of 6 denier, and its brush density may be set to 120,000 F/inch$^2$. Wherein "F" is subscription of fiber. Further, the brush-shaped charging member can be provided in such a state that its tip end portion is in contact with the photoreceptor by about 1 mm.

Then, an excellent image can be maintained over the long term.

BRIEF DESCRIPTION OF THE DRAWINGS

FIG. 5 is a correlation table showing the frequency f of superimposed voltage and peak-to-peak value Vpp concerning the moire images according to an embodiment of the present invention;

FIG. 6 is a correlation table showing the frequency f of superimposed voltage and peak-to-peak value Vpp concerning noise according to an embodiment of the present invention.

DETAILED DESCRIPTION OF THE PREFERRED EMBODIMENTS

Hereinafter, with reference to FIGS. 1 to 7, the description will be made of an embodiment according to the present invention.

Figure 1:
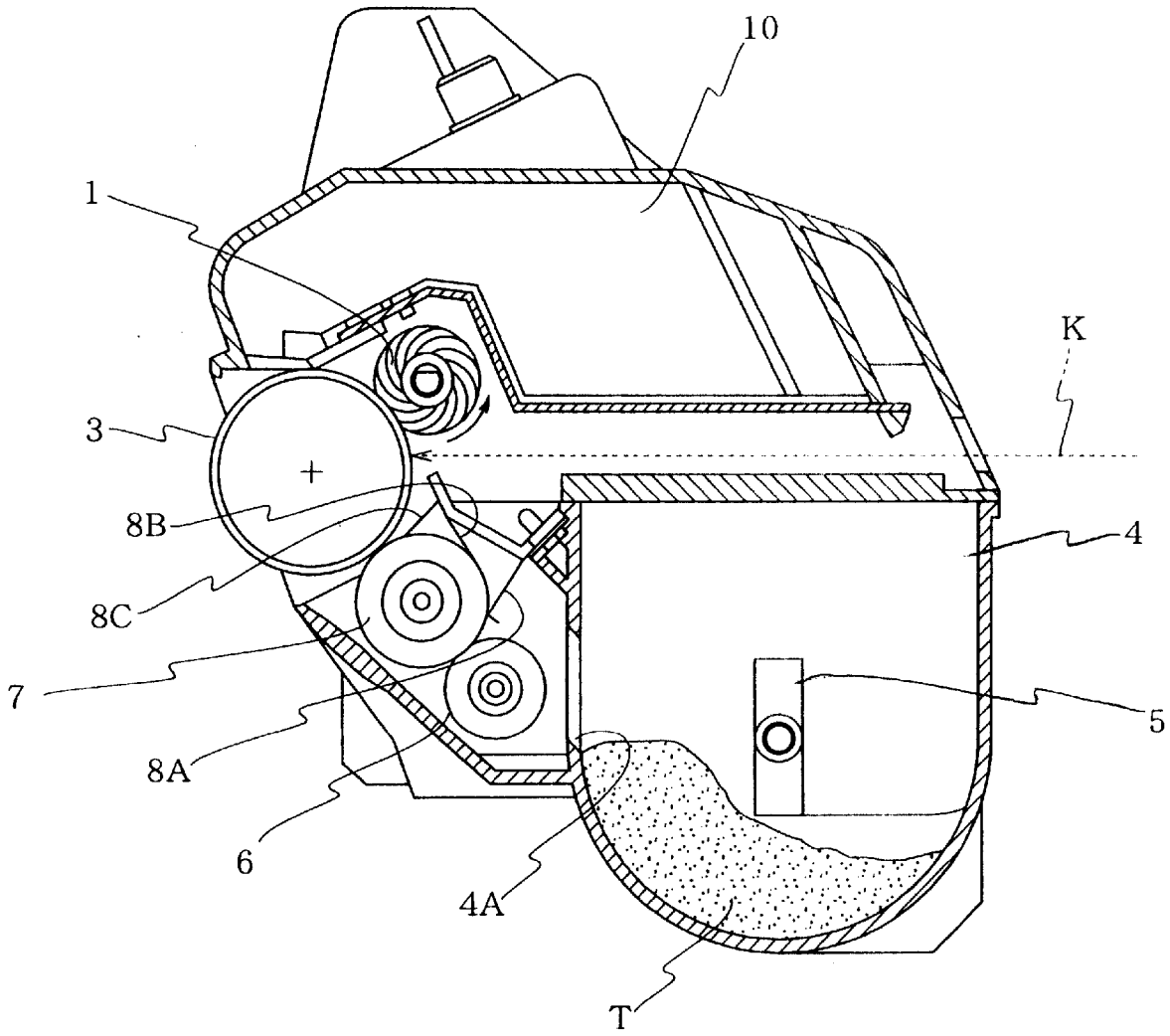
FIG. 1 is a longitudinal sectional view showing an embodiment according to the present invention.

FIG. 1 is a schematic longitudinal sectional view showing an electrophotographic cartridge according to an embodiment of the present invention. This electrophotographic cartridge shown in FIG. 1 has a pillar-shaped brush-shaped charger 1 provided with a brush-shaped charging member made of semi-conductive fiber in the circumference thereof.

This brush-shaped charger 1 uniformly charges the outer peripheral surface, of a photoreceptor 3, made of OPC, Se-series or the like, which has been conventionally utilized as an electrostatic latent image carrier, by applying superimposed voltage of DC voltage and AC voltage to uniformly impart initial potential on the surface of the photoreceptor 3.

On the above-described photoreceptor 3, thereafter, exposure to light K applied to image data from a light source such as a laser, LED or a liquid crystal (not shown) is performed on predetermined points on the outer peripheral surface to thereby form an electrostatic latent image.

On the other hand, toner T is conducted from a toner hopper 4 to a toner supply roller 6 made of conductive or insulating material such as sponge and aluminum, etc. disposed outside the toner hopper 4 by an agitating member 5, and is conducted to a toner carrier (developing roller) 7 provided at the final stage of a development area through the toner supply roller 6. A reference numeral 4A denotes a toner delivery aperture formed on the development side of the toner hopper 4.

The toner carrier 7 is configured by flexible material such as a member surface treated with silicone rubber, urethane rubber, nitrile butylene rubber, natural rubber or sponge.

The toner T conducted to the toner carrier 7 is formed into a uniform thin layer by a plurality of thin-layer forming members 8A, 8B and 8C (only a thin-layer forming member 8A may be used) consisting of spring material made of metal such as stainless steel, phosphor bronze or nickel silver, and is charged by friction. The thin layer of toner T charged on the toner carrier 7 adheres onto the electrostatic latent image on the photoreceptor 3 by an electric field when it is opposed to the photoreceptor 3 to thereby perform development.

Next, the toner image on the photoreceptor 3 is transferred onto a recording medium such as a sheet, OHP film or a postal card by transfer means (not shown). The toner image transferred onto the recording medium is fixed on the recording medium by fixing means (not shown), whereby a predetermined image is print outputted on the recording medium. A reference numeral 10 denotes a cleaner for the photoreceptor 3.

Figure 2:
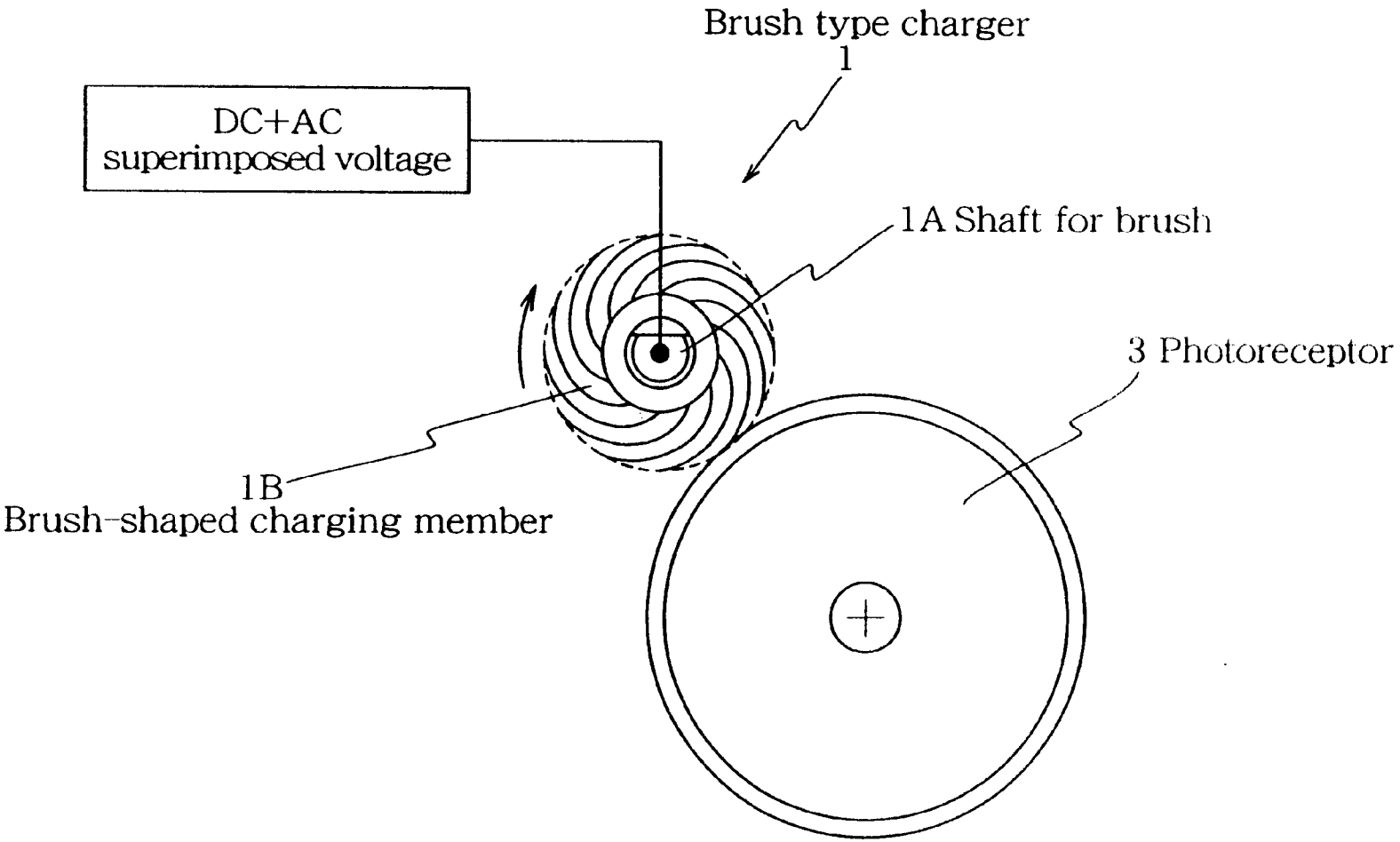
FIG. 2 is an explanatory view showing the relation between the brush type charger and the photoreceptor which are disclosed in FIG. 1.

FIG. 2 is an enlarged explanatory view showing the brush-shaped charger 1 portion disclosed in FIG. 1.

This brush-shaped charger 1 has, as described above, a shaft 1A for brush made of a conductive member, and a brush-shaped charging member 1B which is radially provided toward the outside around the shaft 1A for brush, and which is made of a conductive member entirely formed into a roller shape. This brush-shaped charging member 1B is fixed and provided in a helical fashion around the shaft 1A for brush.

The outer circumference of the brush-shaped charging member 1B is brought into contact with the photoreceptor 3, and at the same time, predetermined DC voltage having AC voltage superimposed thereon is applied to the brush-shaped charging member 1B, whereby the structure is arranged so as to charge the above-described photoreceptor 3.

The brush-shaped charging member 1B is made of conductive rayon yarn having fiber size of 6 denier and brush density of 120,000 F/inch$^2$, and is closely wound around the shaft 1A for brush in a helical fashion and held.

Figure 3:
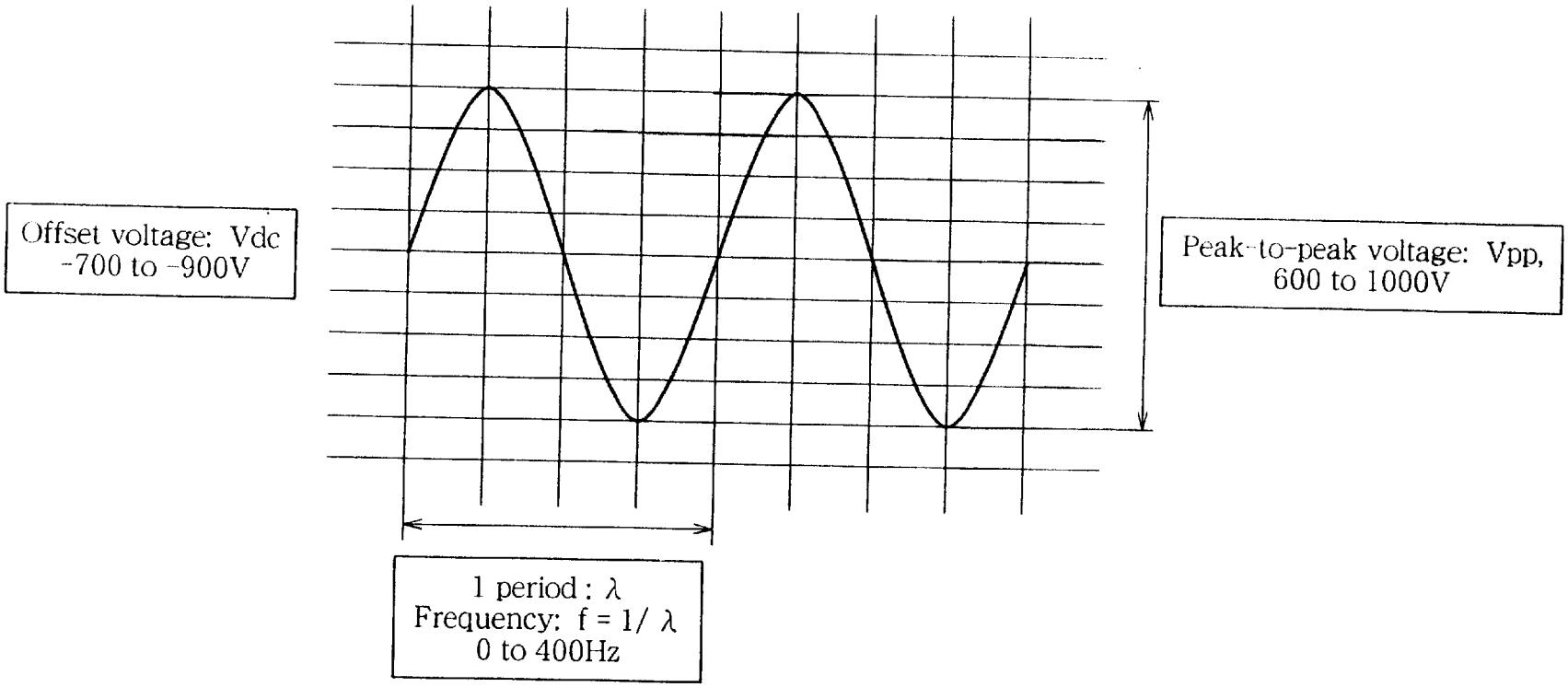
FIG. 3 is an explanatory view showing the waveform of AC component applied to the brush-shaped charging member of the brush type charger disclosed in FIG. 1 and an example of the value.

The shaft 1A for brush is made of conductive stainless steel, and has an outside diameter of 6 mm. In the present embodiment, the shaft for brush is held in such a state that the brush-shaped charging member 1B is in contact with the photoreceptor 3 by 1 mm, and is arranged to rotate in a direction indicated by an arrow. FIG. 3 shows superimposed voltage applied in the present embodiment.

Figure 4:
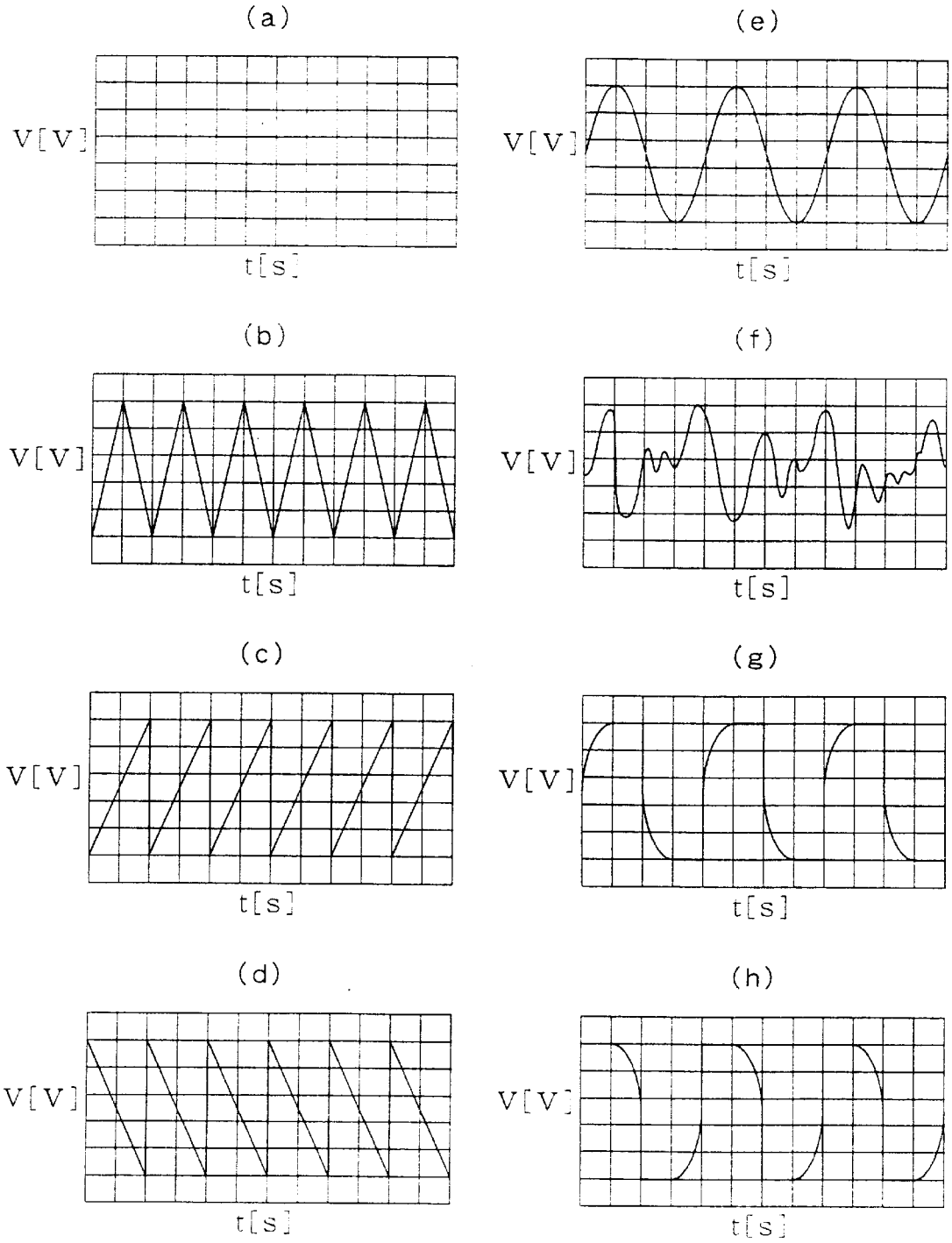
FIGS. 4(*a*) to 4(*h*) are explanatory views showing examples of the waveform of AC component applied to the brush-shaped charging member of the brush type charger respectively.

Further, even if a waveform of such alternating voltage as shown in FIG. 4 is used, a similar operating effect can be obtained. In this case, the frequency f of AC component of superimposed voltage may be made variable.

FIG. 4(*a*) shows square wave-shaped alternating voltage, FIG. 4(*b*) shows triangular wave-shaped alternating voltage having the same inclination in rise and fall, FIG. 4(*c*) shows triangular wave-shaped alternating voltage having a gentle inclination on rise side, and FIG. 4(*d*) shows triangular wave-shaped alternating voltage having a gentle inclination on fall side.

Further, FIG. 4(*e*) shows sine wave-shaped alternating voltage and FIG. 4(*f*) shows alternating voltage in which a plurality of sine wave shapes having different periods at the same level are mixed and FIG. 4(*g*) shows square wave-shaped alternating voltage having a dull state at the end of the variation, and FIG. 4(*h*) shows square wave-shaped alternating voltage having a dull state at the beginning of the variation.

In the above-described embodiment, various experiments were attempted in order to confirm the usefulness. These will be described below.

Voltage after AC component having frequency f=0 to 400 Hz is superimposed on DC voltage of an offset value Vdc="−700" to "−900" V, is applied to the shaft 1A for brush, peak-to-peak value Vpp of AC component is changed, and a dot image is printed as a printer having resolution of 600 dpi and process speed of 90 mm/s to evaluate the print quality from a personal point of view. The result is shown in FIG. 5.

As apparent from FIG. 5, it could be confirmed that moire images and density unevenness pitch were reduced in half over an entire area where f≧100 Hz and offset value Vdc="−700" to "−900" V were satisfied. At the same time, it could be also confirmed that the higher the frequency of alternating voltage was, and the higher the peak-to-peak value Vpp of AC component was, the moire images and density unevenness pitch were brought close to zero unlimitedly (completely eliminated).

Further, the occurrence of noise based on the AC voltage superimposed confirmed at the time was evaluated from a personal point of view. The result is shown in FIG. 6.

As apparent from this FIG. 6, the result could be obtained that in an area of f=300 Hz, noise became higher when the peak-to-peak value Vpp of AC component exceeded 1000 V. In this case, it could be confirmed at the same time that the noise was to such a degree that it could be safely used when the Vpp was 900 V or less.

Figure 7:
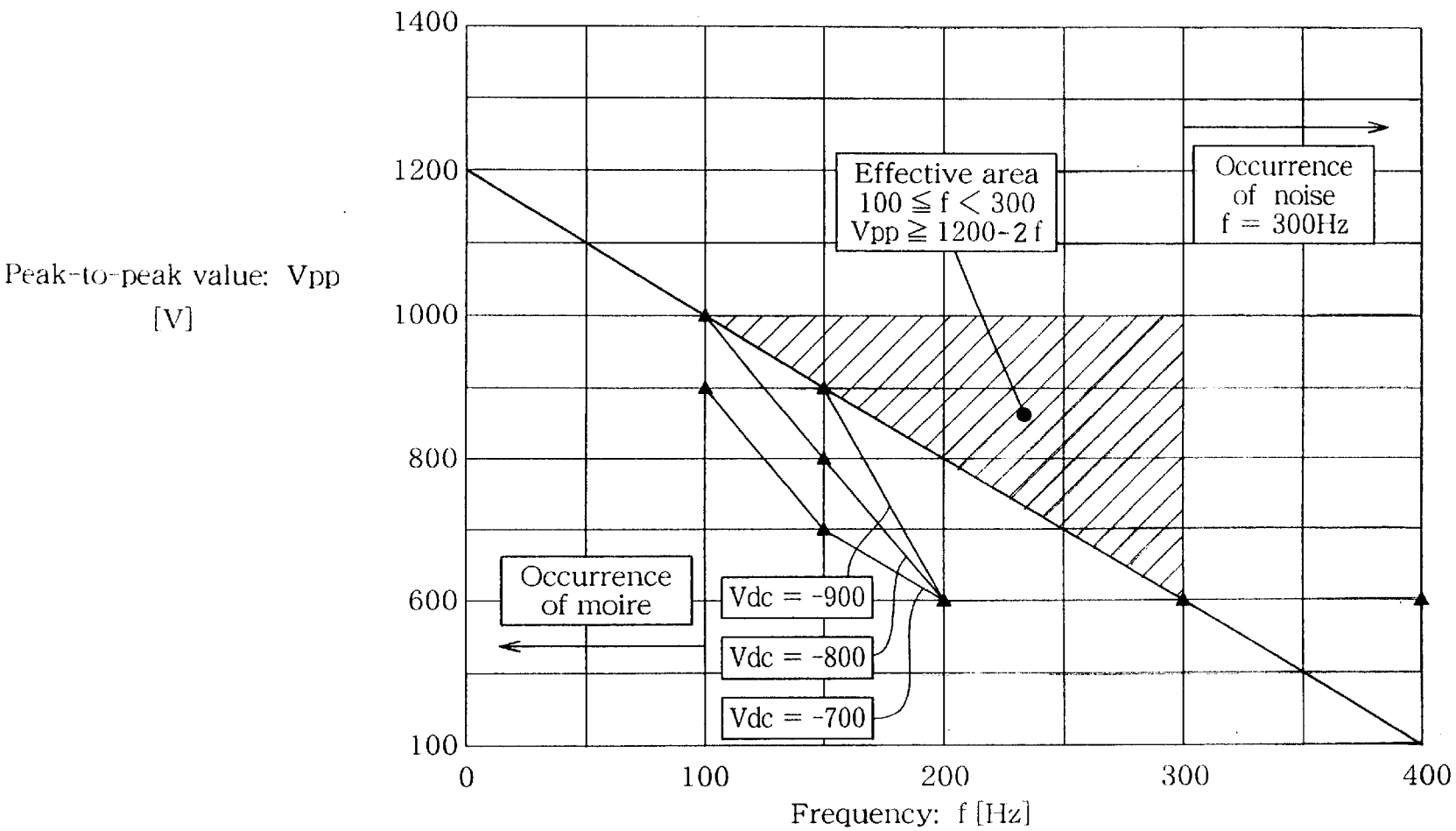
FIG. 7 is a graph showing the effective range of superimposed voltage based on frequency f and peak-to-peak value Vpp according to an embodiment of the present invention.

FIG. 7 summarizes the above-described results of FIGS. 5 and 6.

On the basis of these results, for the frequency f of superimposed voltage to be applied and the peak-to-peak value Vpp, excellent results could be obtained in an area of "f<300 Hz" in terms of occurrence of noise, and in an area of "f≧100 Hz" and "Vpp≧1200−2f" in terms of occurrence of moire images respectively.

Thereafter, the frequency of the superimposed voltage is set to 280 Hz, on the conditions of offset value Vdc=930 V and peak-to-peak value Vpp=900 V, and in a print mode (intermittent print mode) in which printing cycle is stopped after one sheet is printed and stoppage after one sheet is printed again is repeated, printing output was continued.

As a result, an excellent image free from moire-shaped charge irregularities could be obtained over the long term, in which at least 12,000 sheets are printed, without causing any noise.

Since a brush type charger according to the present invention is structured and functions as described above, according to it, the brush-shaped charging member is wound in a helical fashion around the shaft for brush, and therefore, predetermined DC voltage having AC voltage superimposed thereon is applied, and yet the tip end portion of the brush-shaped charging member can abut upon the entire surface of the photoreceptor substantially uniformly by the action of the brush-shaped charging member helically wound. Therefore, it is possible to effectively restrain image defects such as moire images and density unevenness, and to effectively reduce the occurrence of noise at the same time.

Further, the frequency f of AC component of the voltage applied to the brush-shaped charging member is set so as to satisfy relation of 100 Hz≦f<300 Hz, whereby image defects such as moire images and density unevenness can be restrained with reliability, and the occurrence of noise can be also reduced with reliability and heavily.

Furthermore, if the relation between the above-described peak-to-peak value Vpp of AC component and the frequency f of AC component of the voltage applied to the brush-shaped charging member is set so as to satisfy the relation of Vpp≧1200−2f, image defects such as moire images and density unevenness can be restrained with substantially 100% reliability, the occurrence of noise also can be reduced with reliability and heavily to such a degree that no problem is presented in practical use without necessitating any sound-absorbent material, and this state can be maintained for many hours, thus making it possible to increase the reliability on the entire apparatus greatly.

When the frequency f of AC component of the superimposed voltage is made variable, its versatility can be further promoted. As regards the brush-shaped charging member, when it is formed with conductive rayon yarn having fiber size of 6 denier and its brush density is set to 120,000 F/inch$^2$, image defects such as moire images and density unevenness can be restrained with substantially 100% reliability, and this state can be maintained over a long term. Further, when the brush-shaped charging member is provided in such a state that its tip end portion is in contact with the photoreceptor by about 1 mm, an excellent image can be maintained further over the long term, and noise, which occurs on superposing AC component, is also reduced to such a degree that no problem is presented, thus making it possible to provide an excellent brush type charger, which could not be obtained before, not necessitating any sound-absorbent material to be placed inside the photoreceptor, within the apparatus, or inside the process cartridge.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-102975 (Filed on Apr. 14, 1998) including specification, claims, drawings and summary are incorporated herein by reference in its entirety.

What is claimed is:

1. A brush type charger, having a brush shaft made of a conductive member, and a brush-shaped charging member which is radially provided toward the outside around said brush shaft, and which is made of a conductive member entirely formed into a roller shape, structured such that the outer circumference of said brush-shaped charging member is brought into contact with a photoreceptor and predetermined DC voltage having AC voltage superimposed thereon is applied to said brush-shaped charging member being provided in a helical fashion around said brush shaft, wherein the frequency f of the AC component of the voltage applied to said brush-shaped charging member is set so as to satisfy the relation of 100 Hz≦f<300 Hz and the relation between a peak-to-peak value Vpp of the AC component and the frequency f of the AC component of voltage applied to said brush-shaped charging member is set so as to satisfy the relation of Vpp≦1200−2f.

2. The brush type charger according to claim 1, wherein the frequency f of AC component of the superimposed voltage is made variable.

3. The brush type charger according to claim 1, wherein said brush-shaped charging member is formed with conductive rayon yarn having fiber size of 6 denier, and its brush density is set to 120,000 F/inch$^2$.

4. The brush type charger according to claim 3, wherein said brush-shaped charging member is provided in such a state that its tip end portion is in contact with said photoreceptor by about 1 mm.

5. The brush type charger according to claim 1, wherein said brush-shaped charging member is provided in such a state that its tip end portion is in contact with said photoreceptor by about 1 mm.

6. A brush type charger, having a brush shaft made of a conductive member, and a brush-shaped charging member which is radially provided toward the outside around said brush shaft, and which is made of a conductive member entirely formed into a roller shape, structured such that the outer circumference of said brush-shaped charging member is brought into contact with a photoreceptor and predetermined DC voltage having AC voltage superimposed thereon is applied to said brush-shaped charging member being provided in a helical fashion around said brush shaft, wherein the frequency f of the AC component of the voltage applied to said brush-shaped charging member is set so as to satisfy the relation of $100\ \text{Hz} \leqq f < 300\ \text{Hz}$ and the frequency f of the AC component of the superimposed voltage is made variable.

7. The brush type charger according to claim 6, wherein said brush-shaped charging member is formed with conductive rayon yarn having fiber size of 6 denier, and its brush density is set to 120,000 F/inch$^2$.

8. The brush type charger according to claim 7, wherein said brush-shaped charging member is provided in such a state that its tip end portion is in contact with said photoreceptor by about 1 mm.

9. The brush type charger according to claim 6, wherein said brush-shaped charging member is formed with conductive rayon yarn having fiber size of 6 denier, and its brush density is set to 120,000 F/inch$^2$.

10. The brush type charger according to claim 9, wherein said brush-shaped charging member is provided in such a state that its tip end portion is in contact with said photoreceptor by about 1 mm.

* * * * *